United States Patent [19]

Odone et al.

[11] 4,314,239

[45] Feb. 2, 1982

[54] PORTABLE ELECTRONIC ALARM DEVICE

[76] Inventors: Giovanni Odone, chemin du Bochet, 56, CH 1025 Saint-Sulpice, Vaud; Willy Buchs, chemin Montaux, CH 1027 Lonay, Vaud, both of Switzerland

[21] Appl. No.: 103,406

[22] Filed: Dec. 13, 1979

[51] Int. Cl.[3] ..... G08B 13/18

[52] U.S. Cl. ..... 340/556

[58] Field of Search ..... 340/556, 557, 555

[56] References Cited

U.S. PATENT DOCUMENTS

| | | | |
|---|---|---|---|
| 2,468,042 | 4/1949 | Cranberg | 340/556 |
| 3,842,257 | 10/1974 | Köhler | 340/555 |
| 4,068,222 | 1/1978 | Treviranus | 340/556 |
| 4,156,883 | 5/1979 | Walter et al. | 340/556 |

*Primary Examiner*—Glen R. Swann, III

*Attorney, Agent, or Firm*—Emory L. Groff, Jr.

[57] ABSTRACT

To detect an intrusion the apparatus projects one or, better, two beams of infrared rays in a direction selected by the user. A lens collects part of the radiation diffused back by the surface on which the beam impinges (whose distance must be in the range covered by the apparatus) and concentrates the collected radiation to form an image, almost pin point, of the "illuminated" surface. The position of said image depends on the distance of the surface impinged on by the beam. A photodetector provided with a slit placed in front is displaced until it detects the radiation forming the image. When the intruder intercepts the beam, the image of the "illuminated" surface, which is now on the intruder, will shift sideways enough to prevent the rays from passing through the slit and therefore from reaching the photodetector. The absence of the photodetector output signal indicates that an intrusion is occuring.

The apparatus may be enabled to perform as fire detector, by means of a second photodetector fixed beside the former and before the diaphragm.

15 Claims, 3 Drawing Figures

LASER BEAM GENERATOR
SERVO MOTOR
ELECTRONIC CONTROL CIRCUIT

PORTABLE ELECTRONIC ALARM DEVICE

This invention is related to a portable electronic alarm device to detect and to signal an intrusion, chiefly intended for use in houses, flats, shops, kiosks, stands, etc. It consists of two units: a detector and a conventional alarm means. The two units can be placed together in a common housing or separated and connected by a wire or by a remote control device. The conventional alarm means will not be described because it is already known.

BACKGROUND AND PRIOR ART

Among so many systems already known able to detect an intrusion, the most reliable are the ones of optoelectronic kind. They consist of a projector which directs a beam of infrared rays into a facing receiver. When the intruder, passing between the projector and the receiver, intercepts the beam, the very fact that the excitation of the receiver is broken gives rise to the information that an intrusion is occuring.

The drawback of these systems is that they need immovable installations. In fact the projector and the receiver must be mounted into a fixed and separated support and must be well aligned. When the distance between the units exceed a few meters, the alignment becomes difficult also because the infrared radiation projected is invisible. Therefore not only the device cannot be easily displaced everytime at will of the user, but, considering also the aesthetic requirements of the room, it is to install only in particular places as for instance the door or window spaces. The limitations to the choice of the vigilance direction, in practice, involves the need of several apparatus in order to achieve a sufficient degree of defence.

PURPOSE AND ADVANTAGES OF THE INVENTION

The purpose of this invention is an apparatus of optoelectronic kind able to detect an intrusion. It is compact, movable, covers a great range, economical, and does not require any installation. It is of easy use, having a great immunity as regards spurious intrusions, and allows any choice of vigilance direction. It is energized by batteries.

Owing to compactness, mobility, great covered range, only one apparatus allows the vigilance of a house, at least in the most frequent cases. We point out the advantage that the apparatus may be easily adapted also as fire detector.

The invention is illustrated in the accompanying drawings, wherein.

DESCRIPTION OF THE INVENTION

Figures 1, 2:
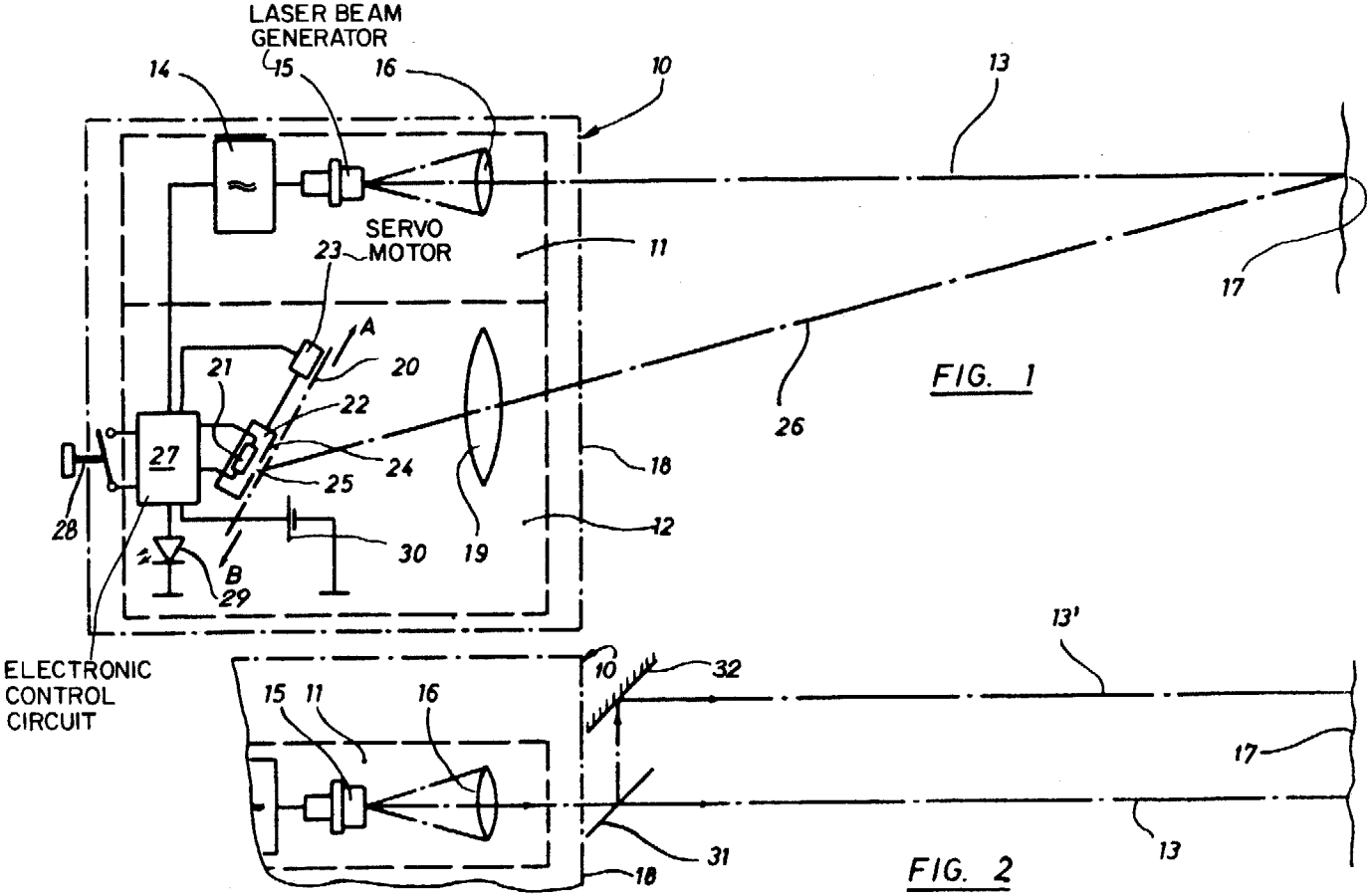
FIG. 1 is a schematic view of one form of the alarm device.
FIG. 2 is a schematic view of a second form of the alarm device.
Figure 3:
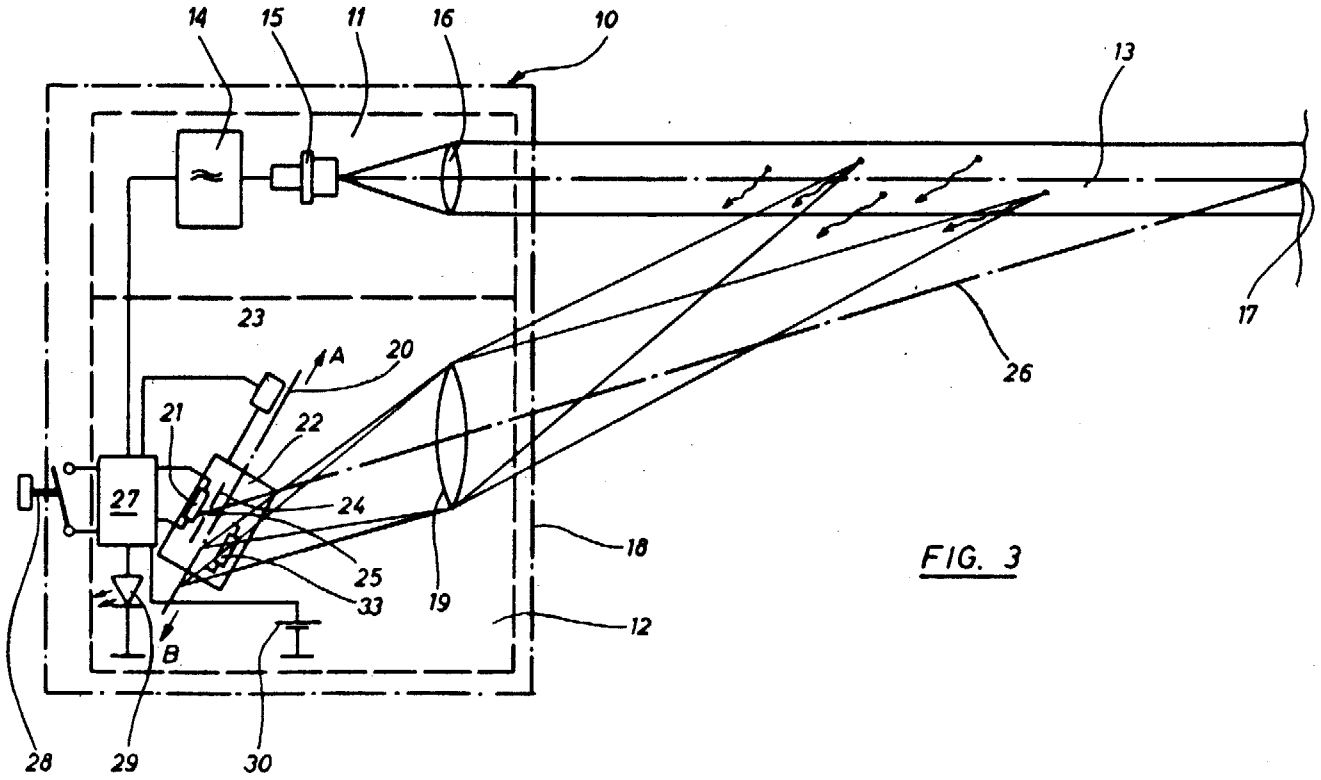
FIG. 3 is a schematic view of a third form of the alarm device which is adapted to be activated by an intruder or by smoke from a fire.

At first the invention will be described with reference to the FIG. 1, which indicates a schematic side view of a first preferential embodiment of the apparatus according to the present invention.

Apart from the conventional alarm means, the apparatus consists of:

1. A projector (11) composed of a light pulse generator (14), preferably a Laser-diode (15), adjusted once and for all near the focus of the lense (16) in such a way that the latter projects a compact beam (13) of infrared rays focused approximately at the maximum covered range (15 meters, for instance). The beam (13) comprises a sequence of individual radiation pulses. The beam will be pointed in the direction selected by the user and it will impinge on an object, for instance a wall, a piece of furniture, a curtain, a door, etc., but no object more distant than the maximum range of the apparatus.

2. A receiver (12) mounted beside the projector, in a common housing (18). The receiver is composed of an optical convergent element, preferably a lens (19) and a movable detector assembly (22) on which a photodetector (21) and a diaphragm (24) are mounted. This diaphragm has preferably the form of a slit (25) (or a blade covering a part of the photoelectric layer), placed in front of the photodetector (21). The optical axis of the lens (19) is approximately parallel to the projected beam (13). The lens (16) is placed beside an exit aperture (in the housing) (10). If the maximum range covered by the apparatus is, for instance, 15 meters, the distance between the axis of the lens and the axis of the beam (13) is approximately 100 mm. The lens (19) collects part of the infrared radiation indicated by reflected beam (26) diffused back by the surface (17) of the object, on which the beam (13) impinges, and concentrates the collected radiation to form an image of the region impinged on by the beam on a plane (20) which is inclined relative to the axis of lens (19). The position of plane (20) is so determined that relatively sharp images will be formed on it for the different distances of the beam impinged on region (17). Said images, which are almost a point, move from the position indicated in FIG. 1 in the direction of arrow B for decreasing distance of region (17) and in direction of arrow A, when the distance increases. The slit (25) or the blade edge, is approximately normal to the image moving direction.

The slit (25) (and consequently the photodetector (21)) may be displaced by a suitable mechanism, for example, a servo motor (23) so that the slit can run on the plane (20) until the image position is reached. At this moment only, the infrared rays of beam 26, passing through the slit, reach the photodetector, which therefore will supply pulses in coincidence with the Laser-diode pulses. A monitor or indicator light, for instance, a LED (29) controlled by the photodiode pulses, indicates that the slit has reached the required position. Obviously the slit will not be necessary if the photosensitive area of the photodetector has already the form of a narrow slit.

The movable detector assembly may be displaced manually by a screw ring or automatically by a servomotor (23), whose direction of rotation can be reversed.

If desired, the position of the plane (20) may be translated in a position parallel to the optical axis of the lens (19) by a reflexion on a plan mirror which is bisector of the dihedral angle formed by the plane (20) and the new plane.

Of course the receiver comprises also an electronic device (27) energized by batteries (30), able to process the signals supplied by the photodetector and able to control the Laser-diode pulses and to supply and to transmit to one or more alarm means the control signal when an intrusion takes place. The electronic device comprises also a multipole push switch (28), the function of which will be explained later. It allows the separation of the starting phase of the apparatus from the duty phase. As the electronic device is of a conventional kind, it will not be described. We only add that in order to reduce the power consumption, an electronic switch (a transistor) driven by a central clock, periodically interrupts the feed of some electronic circuits, as for instance, the photodetector output amplifier, the trigger, etc. during a part of the period between two Laser-diode pulses. It allows a greater reduction of average consumption, because the pulses frequency repetition rate may be relatively slow, 12 Hz, for instance, and the pulse duration may be 100 n.second only.

Operation

At first the apparatus is laid on a support, for instance a piece of furniture, a chair, etc., and pointed in the most favourable vigilance direction, chosen by the user. The starting phase consists in pressing the switch (28) until the slit (25) driven by said servomotor (connected by the same switch (28) with the power), reaches the image position and consequently the monitoring LED (29) lights up. A stop signal is transmitted to the motor in coincidence with the LED (29) control signal. If the movable detector assembly (22) is to be displaced manually, the user must adjust assembly (22) until the LED lights up. At this moment the apparatus will be in duty.

When an intruder intercepts the Laser beam, the length of the beam will become shorter, and, consequently, the angle of the reflected beam (26) will shift and prevent the rays from passing through the slit (25) and from reaching the photodetector (21), which therefore will not supply anymore pulses. This very fact indicates that an intrusion is occuring. As soon as the photodetector output signal fails to reach the selected threshold signal, the alarm signal may be transmitted. Of course the same effect would be obtained if the distance, instead of becoming shorter, would get longer: so every attempt to deviate the beam, for instance by a mirror, would in practice cause the alarm.

The FIG. 2 shows a second embodiment of the invention, which is different from the first essentially because two almost parallel beams (13 and 13') are projected, instead of only one beam. The plane through their axis is set so that the images of the two impinged on regions are formed aligned on the same slit (25). This fact increases the reliability of the apparatus regarding spurious intrusions (big flies, butterflies, etc.) intercepting the beam, because the alarm signal is provided only if both beams are simultaneously intercepted. FIG. 2 indicates how the two beams are originated by one light pulses generator only.

Now it is time to explain the functions of the switch (28), whose purpose is to separate the starting phase of the apparatus from the duty phase. Its functions are mainly:

(a) to reduce the receiver (12) sensivity, for instance by reducing the Laser current pulses and therefore the power beam by more than 50%. It makes sure that, when the LED (29) lights up, the slit (25) will be sufficiently well centered on the image, so that the photodetector (21), will go on supplying pulses higher than the threshold of the trigger, even if one of the beams (13 or 13'), intercepted by a spurious subject of intrusion, does not excite the photodetector (21) anymore. A reduction of the beam power of more than 50% (70% for instance), secures a margin of safety with respect to the transmission lowering of the optical elements caused by a progressive increase of dust or respect to fluctuations of Laser power following great temperature variations. The same effect would be obtained by reducing the gain of the photodetector output signals amplifier.

(b) to increase the Laser pulse frequency, for instance from 12 Hz to 50 Hz, in order to make the centering of the slit (25) on the image easier, because otherwise the image position could be reached and surpassed within two pulses running: in this case the LED (29) will not light up. It is clear that the lower the pulse frequency rate, the lower will be the supplying current;

(c) to connect the monitoring LED (29) circuit;

(d) to block the alarm signal transmission;

(e) to connect the servomotor with the power and to let pass the motor stop signal;

(f) to connect the circuit of the battery charge meter.

How to get the apparatus to perform as fire detector

The device may be easily completed in order to perform also as a fire detector. This purpose is achieved essentially by mean of a second photodetector (33) placed beside and before the slit (25), as indicated in FIG. (3).

As previously described, in absence of the intruder, the image of the region impinged on by the beam is formed centred on the slit (25). Consequently the second photodetector (33) will not be excited and therefore will supply no pulses. But, in presence of smoke on the flight path of the Laser beam (13), the particles which form smoke will diffuse back part of the radiation of the beam. As the scattering occurs at distances shorter than the beam impact point (17), the lens (19) will concentrate part of this scattered radiation to the side of the slit (25) where the second photodetector (33) is placed, which therefore will supply pulses in coincidence with the Laser diode (15) pulses. The very fact gives rise to the information that a fire is occuring.

In order to reduce the power consumption, the second photodetector (33), together with its amplifier and the trigger, will be connected by a suitable electronic switch (30), to the voltage source only periodically (every 30 seconds, for instance), with a low duty cycle.

As soon as the photodetector (33) output pulses reach the selected trigger threshold, the alarm signal will be transmitted.

Various changes and modifications may be made within the scope of the inventive concepts.

We claim:

1. Apparatus for detecting and signalling intrusions, comprising in a common housing (10):

means (14,15,16) for transmitting in a selected direction at least one compact beam (13) of radiation pulses; at least one convergent optical element (19) which receives part of the radiation transmitted in said beam (13) and reflected from a surface (17) on which the beam impinges, positioned for concentrating said received radiation to form an image of said surface, the position of said image relative to said optical element (19) being dependent upon the distance of the surface (17) from the apparatus; movable detector means (21,24,25), comprising at least one photodetector (21), movable relatively to said image position and sensitive to said image position relatively to its own position, for furnishing, during a starting phase of the apparatus, a stop signal when their positions have a predetermined relationship and for furnishing during a duty phase a signal representative of an intrusion when said relationship is broken; means for moving said detector means until receipt of said stop signal; at least one electronic device (27) for processing the signals supplied by the photodetector (21) and therefor for furnishing said stop signal and said alarm signal and for transmitting it to one, or more, alarm means and also for controlling the radiation transmitter (15); a switch 28, connected with the electronic device (27) for controlling movement of said detector means;

a means, controlled by said stop signal, for indicating that said movable detector means is in the required position; the whole being arranged in such a way that, during the starting phase and therefore in absence of the intruder, either the movable detector means (21,23,24,25) or said image position can be displaced till the predetermined relationship is achieved, whereat the signals supplied by said photodetector (21) have a predetermined relationship to predetermined threshold signals and in such a way that when an intruder intercepts the beam the consequent change of the image position of the surface impinged on by the beam (13), which at this time is on the intruder, causes a sensibly extreme variation of signals supplied by the photodetector (21) so that this abrupt variation suitably processed by said electronic device (27), gives rise to a signal representative of the intrusion.

2. Apparatus as set forth in claim 1 wherein said optical convergent element comprises a lens (19) placed beside and at predetermined distance from the exit aperture, in the housing (10), of the transmitted beam (13).

3. Apparatus as set forth in claim 1, wherein said movable means comprise at least one photodetector (21) and a diaphragm (24) placed in front of said photodiode sensitive area.

4. Apparatus as set forth in claim 3, wherein said diaphragm has a narrow slit oriented normal to the direction of movement of said image.

5. Apparatus as set forth in claim 4 wherein said slit (25) is movable on a plane (20) selected in such a way that the optical element (19) forms on it a relatively sharp image of the area (17) impinged on by the beam (13) independently of its distance, on condition that the distance is not out of the range covered by the apparatus.

6. Apparatus as set forth in claim 1 wherein the photosensitive layer of the photodetector is movable on the plane (20).

7. Apparatus as set forth in claim 5, wherein said plane (20), is translated in a new optically equivalent plane parallel to said lens (19) axis by reflexion on a plane mirror which approximately bisects the dihedral angle formed by the plane (20) and the new plane.

8. Apparatus as set forth in claim 1, wherein said transmitting means comprising a convergent lens (16) and a generator of radiation pulses (14), comprising a Laser-diode (15) placed behind said lens, at a predetermined distance.

9. Apparatus as set forth in claim 8 wherein said transmitting means projects two beams (13 and 13') approximately parallel and of equal intensity; and wherein the two said beams are so disposed that the images of the two impinged on areas are formed aligned on the same slit (25).

10. Apparatus as set forth in claim 9, wherein the two said beams (13 and 13') are generated by a single radiation pulse generator, by means of two flat parallel mirrors (31 and 32), placed in front of the lens, one of which is semireflecting (31).

11. Apparatus as set forth in claim 1, wherein during the starting phase of the apparatus the frequency repetition rate of said radiation pulses forming the beam (13) is increased and, or, the energy of said individual pulses is reduced.

12. Apparatus as set forth in claim 1, wherein the sensibility of said movable detector means is reduced during the starting phase of the apparatus.

13. Apparatus as set forth in claim 1, wherein said detector movable assembly comprises also a second photodetector (33) placed beside the first photodetector (21) in such a way that it can be excited by the radiation concentrated by said optical convergent element (19), when the transmitted beam (13) impinges on areas, whose distance is shorter than the one previously set during the starting phase of the apparatus.

14. Apparatus as set forth in claim 13, wherein the second photodetector (33) output signal is so processed by said electronic device (27) that, when it is higher than a predetermined trigger threshold, it gives rise to the alarm signal.

15. Apparatus as set forth in claim 1 wherein said electronic device (27) comprises also an electronic switch (30), which periodically disconnects the feed of some electronic elements during a part of the time between radiation running pulses.

* * * * *